US008415594B2

(12) United States Patent
Schilling et al.

(10) Patent No.: US 8,415,594 B2
(45) Date of Patent: Apr. 9, 2013

(54) METHOD FOR OPERATING AN INDUCTION HEATING DEVICE

(75) Inventors: Wilfried Schilling, Kraichtal (DE); Ralf Dorwarth, Oberderdingen (DE); Martin Volk, Baden-Baden (DE); Tobias Schönherr, Kraichtal (DE)

(73) Assignee: E.G.O. Elektro-Geraetebau GmbH, Oberderdingen (DE)

( * ) Notice: Subject to any disclaimer, the term of this patent is extended or adjusted under 35 U.S.C. 154(b) by 1357 days.

(21) Appl. No.: 12/101,419

(22) Filed: Apr. 11, 2008

(65) Prior Publication Data

US 2008/0203087 A1 Aug. 28, 2008

Related U.S. Application Data

(63) Continuation of application No. PCT/EP2006/009916, filed on Oct. 13, 2006.

(30) Foreign Application Priority Data

Oct. 14, 2005 (DE) ..... 10 2005 050 038

(51) Int. Cl.
*H05B 6/02* (2006.01)
*H05B 6/04* (2006.01)

(52) U.S. Cl.
USPC ..... 219/600; 219/660

(58) Field of Classification Search ..... 219/660, 219/1, 6, 7, 4, 3, 661, 663, 664, 668
See application file for complete search history.

(56) References Cited

U.S. PATENT DOCUMENTS 3,569,810 A * 3/1971 Thiele ..... 388/819
3,637,974 A * 1/1972 Tajbl et al. ..... 219/130.4
3,787,756 A * 1/1974 Berger ..... 363/53
3,914,575 A * 10/1975 Eichler ..... 219/121.36
4,277,667 A 7/1981 Kiuchi (Continued)

FOREIGN PATENT DOCUMENTS

EP 0269417 6/1988
JP 63-13294 1/1988

(Continued)

OTHER PUBLICATIONS

International Search Report from PCT/EP2006/009916 dated Feb. 5, 2007.

(Continued)

*Primary Examiner* — Jermele M Hollington
(74) *Attorney, Agent, or Firm* — Alston & Bird LLP

(57) ABSTRACT

The invention relates to a method for operating an induction heating device. The induction heating device comprises an induction coil and a frequency converter for producing a control voltage for the induction coil. The frequency converter comprises a rectifier rectifying an alternating supply voltage (UN), an intermediate circuit capacitor, looped in between output terminals of the rectifier and equalizing the rectified voltage (UG), and at least one controllable switching element, looped in between the output terminals of the rectifier. According to the invention, in a predetermined discharge interval (INT) before a zero crossing (ND) of the alternating supply voltage (UN), the intermediate circuit capacitor is discharged to a threshold value by controlling the at least one switching element before the induction coil is controlled in order to produce an adjustable heating capacity.

17 Claims, 4 Drawing Sheets

U.S. PATENT DOCUMENTS

| | | | | | |
|---|---|---|---|---|---|
| 4,338,503 | A | | 7/1982 | Ito et al. | |
| 4,438,311 | A | | 3/1984 | Tazima et al. | |
| 4,736,082 | A | * | 4/1988 | Matsuo et al. | 219/626 |
| 4,779,038 | A | * | 10/1988 | Eckerfeld | 323/322 |
| 5,354,971 | A | | 10/1994 | Chen | |
| 5,376,775 | A | * | 12/1994 | Lee | 219/665 |
| 5,526,103 | A | * | 6/1996 | Kato et al. | 399/328 |
| 5,537,074 | A | * | 7/1996 | Iversen et al. | 327/564 |
| 5,648,008 | A | * | 7/1997 | Barritt et al. | 219/626 |
| 5,654,882 | A | * | 8/1997 | Kanazawa et al. | 363/37 |
| 5,731,681 | A | * | 3/1998 | Inaniwa et al. | 318/729 |
| 6,021,052 | A | * | 2/2000 | Unger et al. | 363/26 |
| 6,118,186 | A | * | 9/2000 | Scott et al. | 290/40 B |
| 6,660,981 | B2 | * | 12/2003 | Ogata et al. | 219/622 |
| 2004/0129696 | A1 | * | 7/2004 | Doi et al. | 219/619 |
| 2004/0246641 | A1 | * | 12/2004 | Sugimoto et al. | 361/91.1 |
| 2009/0230123 | A1 | * | 9/2009 | Egenter et al. | 219/660 |
| 2010/0006563 | A1 | * | 1/2010 | Schilling et al. | 219/661 |
| 2011/0120989 | A1 | * | 5/2011 | Schilling et al. | 219/661 |

FOREIGN PATENT DOCUMENTS

| | | | | |
|---|---|---|---|---|
| JP | 1-232688 | | | 9/1989 |
| JP | 2002075622 | A | * | 3/2002 |
| JP | 2002075622 (A) | | | 3/2002 |
| JP | 2005078914 | A | * | 3/2005 |
| JP | 2005078914 (A) | | | 3/2005 |
| JP | 2005-116522 | | | 4/2005 |
| JP | 2005116522 | A | * | 4/2005 |
| JP | 2005/122965 | A | | 5/2005 |
| JP | 2005122965 | A | * | 5/2005 |

OTHER PUBLICATIONS

German Search Report from German Application No. 10 2005 050 038.2.

Japan Patent Office, Office Action for Application No. 2008-534942, mailed Apr. 10, 2012, 4 pages, Tokyo.

Japan Patent Office, Office Action for Application No. 2008-534942, mailed Jan. 22, 2013, 4 pages, Japan.

* cited by examiner

METHOD FOR OPERATING AN INDUCTION HEATING DEVICE

CROSS REFERENCE TO RELATED APPLICATIONS

This application is a continuation of PCT/EP2006/009916, filed Oct. 13, 2006, which in turn claims priority to DE 10 2005 050 038.2, filed on Oct. 14, 2005, the contents of both of which are incorporated by reference.

FIELD OF THE INVENTION

The invention relates to a method for operating an induction heating device to produce an adjustable heating capacity.

BACKGROUND OF THE INVENTION

In induction heating devices an induction coil is supplied with an alternating voltage or an alternating current, so that in a cooking utensil coupled magnetically to the induction coil and which is to be heated, eddy currents are induced, which give rise to a heating of the utensil.

Different circuit arrangements and control methods are known for controlling the induction coil. It is common to all the circuit and method variants that they generate a high frequency control or drive voltage for the induction coil from a low frequency input supply voltage. Such circuits are referred to as frequency converters.

For converting or frequency converting, normally the input supply voltage initially is rectified with the aid of a rectifier into a direct supply voltage or intermediate circuit voltage and subsequently processed for generating the high frequency control voltage with the aid of one or more switching elements, generally insulated gate bipolar transistors (IGBTs). Normally there is a so-called intermediate circuit capacitor for buffering the intermediate circuit voltage at the output of the rectifier, i.e. between the intermediate circuit voltage and a reference potential.

A first converter variant is formed by a converter in full bridge circuit, in which two so-called half-bridges are serially looped in between the induction coil and a capacitor. The half-bridges are in each case looped in between the intermediate circuit voltage and the reference potential. The induction coil and the capacitor form a series resonant circuit.

Another converter variant is formed by a half-bridge circuit of two IGBTs, the induction coil and two capacitors, which are serially looped in between the intermediate circuit voltage and the reference potential, forming a series resonant circuit. One terminal of the induction coil is connected to a junction point of the two capacitors and its other terminal is connected to a junction point of the two IGBTs forming the half-bridge.

Both the full bridge and the half-bridge variant are comparatively expensive as a result of the large number of components required, particularly IGBTs.

An optimized variant from the costs standpoint consequently uses a single switching element or a single IGBT, the induction coil and a capacitor forming a parallel resonant circuit. The parallel resonant circuit of induction coil and capacitor are looped in serially with the IGBT between the output terminals of the rectifier and parallel to the intermediate circuit capacitor.

It is common to all the aforementioned converter variants that during a first supply half-wave the intermediate circuit capacitor is charged to a no-load voltage with an amount of a peak value of the alternating supply voltage, e.g. to 325 V in the case of a 230 V alternating supply voltage as soon as it is supplied with said supply voltage.

If no control voltage is generated for generating the induction coil power, i.e. if the switching element or elements or IGBTs are inhibited, the voltage at the intermediate circuit capacitor remains roughly constant. On starting the frequency converter, i.e. if the induction coil is driven or controlled for generating an adjustable heating power or is supplied with an alternating voltage, on switching on the IGBT or IGBTs, initially a high current flows out of the intermediate circuit capacitor into the resonant circuit and through the IGBT or IGBTs. This gives rise to an audible noise in a cooking utensil heated by the induction heating device, e.g. in the bottom of a saucepan. There is also a reduction to the service life of components supplied with the high starting current.

Thus, a problem addressed by the invention is to provide a method for operating an induction heating device with a frequency converter, which permits a reliable, component-protecting and low-noise operation of the induction heating device with limited radiated interference.

SUMMARY OF THE INVENTION

The invention solves this problem by a method for operating an induction heating device comprising an induction coil, and a frequency converter for generating a control voltage for the induction coil comprising a rectifier which rectifies an alternating supply voltage, an intermediate circuit capacitor coupled between output terminals of the rectifier and buffering the rectified voltage, and at least one controllable switching element coupled between output terminals of the rectifier, the method comprising: prior to a zero passage of the alternating supply voltage, discharging the intermediate circuit capacitor to a threshold value by controlling the at least one switching element before the induction coil is controlled for generating an adjustable heating power.

Advantageous and preferred embodiments of the invention form the subject matter of the further claims and are explained in greater detail hereinafter. By express reference the wording of the claims is made into part of the content of the description.

According to one embodiment of the invention, in a time interval prior to a zero passage of the alternating supply voltage, the intermediate circuit capacitor is discharged down to a threshold value through controlling a switching element, before the induction coil is controlled or activated, for generating an adjustable heating power or capacity, and during the discharge there is a limited heating power supplied to the optionally present cooking utensil. In one embodiment, the intermediate circuit capacitor is discharged in a predeterminable discharge time range prior to the zero passage of the alternating supply voltage. As a result of the intermediate circuit capacitor discharge, on starting a heating process, i.e. if the induction coil is to supply heating power to a cooking utensil, the intermediate circuit capacitor is substantially discharged. If at this time the switching element is switched through or becomes conductive, there is either no or only a limited pulse of current through the switching element and the resonant circuit of induction coil and capacitor. As a result there is no start-up noise and the pulsed current loading of the power components is reduced, so that their service life is increased. Following the discharge of the intermediate circuit capacitor the actual heating process can take place in the normal way, e.g. the switching element or elements can be controlled by a square-wave signal with an operating frequency and an associated operating duty cycle. Consequently the frequency converter is started with low currents or voltages in the zero passage area. With the rise of the half-wave following the zero passage, the converter can regulate to its operating point corresponding to the set heating power with an operating frequency and an operating duty cycle.

In a further embodiment the frequency converter is a single transistor converter. The at least one switching element preferably forms the single transistor converter switching element. Alternatively the converter is constructed in full bridge or half-bridge circuit form and the at least one switching element forms part of a bridge.

In a further embodiment the time range 1 to 5 ms, preferably 2.5 ms, begins prior to the zero passage of the alternating supply voltage. This allows a reliable discharge of the intermediate circuit capacitor, in the case of a comparatively limited power loss generation in the switching element through the discharge process.

In a further embodiment the threshold value is in the range 0 to 20 V. Preferably the intermediate circuit capacitor is discharged to 0 V. This permits a substantially pulsed current-free converter starting.

In a further embodiment the at least one switching element is a transistor, particularly an IGBT. For discharging the intermediate circuit capacitor, the transistor is preferably controlled during the discharge such that there is a linear transistor operating state. As in this mode or operating state the transistor does not completely switch through, the intermediate circuit capacitor is slowly discharged along the supply half-wave. The resulting currents through the parallel resonant circuit and the transistor remain comparatively low, so that noise evolution is avoided or significantly reduced.

In a further embodiment for discharging the intermediate circuit capacitor the switching element is controlled by a pulse-width modulated square-wave voltage signal. Preferably the square-wave voltage signal has a frequency of 20 to 50 kHz, particularly 39 kHz, and/or an on/off ratio in the range 1/300 to 1/500, particularly 1/378. This can bring about a controlled intermediate circuit capacitor discharge without an excessive discharge current flowing. The frequency and/or on/off ratio is preferably adapted to the IGBT type used, its control voltage, a control circuit used for generating the control voltage and/or to a capacitance value of the intermediate circuit capacitor.

In a further embodiment the adjustable heating power or capacity is generated with the aid of a half-wave pattern, the intermediate circuit capacitor being discharged prior to the activation of a half-wave. When the heating power is generated with the aid of the half-wave pattern, individual half-waves of the alternating supply voltage are completely extracted or deactivated, i.e. not used for heating power generation. In a so-called ⅓ supply half-wave operation, for example, only one of three successive half-waves is used or activated for feeding in power into the resonant circuit or induction coil. During the remaining two half-waves the switching element remains open, i.e. no power is fed into the resonant circuit. In a ⅔ supply half-wave operation two of three successive half-waves are used or activated for feeding power into the resonant circuit or induction coil. During an active half-wave, power adjustment takes place in the usual way. Supply half-wave operation permits a finer resolution of power stages over a considerable power adjustment range. Such a power adjustment is particularly advantageous for single transistor converters. If in the case of a conventional operating method of the single transistor converter, use is made of a half-wave operation for power adjustment, during an inactive half-wave, i.e. a half-wave during which no power is fed into the resonant circuit, there is a no-load voltage, e.g. 325 V in the case of a 230 V supply voltage, at the intermediate circuit capacitor.

On switching through the switching element for the first time during transit from a non-active to an active half-wave, briefly there is a high current flow through the resonant circuit and the switching element so that, as stated, noise is caused. Thus, in ⅓ and ⅔ supply half-wave operation a noise occurs every 3 ms, which is not acceptable to the user. Thus, in the case of conventional single transistor converters normally no use is made of half-wave control for power adjustment. When using the inventive discharge of the intermediate circuit capacitor prior to the activation of a half-wave, i.e. on transition from a deactivated to an activated half-wave, at a transition there is no high starting current. That is, a half-wave control can also be used in the case of the single transistor converter for power adjustment purposes. Preferably one of three or two of three half-waves are activated, i.e. ⅓ or ⅔ supply half-wave operation is set.

These and further features can be gathered from the claims, description and drawings and the individual features, both singly or in the form of subcombinations, can be implemented in an embodiment of the invention and in other fields and can represent advantageous, independently protectable constructions for which protection is claimed here. The subdivision of the application into individual sections and the subheadings in no way restrict the general validity of the statements made thereunder.

BRIEF DESCRIPTION OF THE DRAWINGS

Embodiments of the invention are described hereinafter relative to the attached diagrammatic drawings, wherein show.

DETAILED DESCRIPTION OF THE EMBODIMENTS

Figure 1:
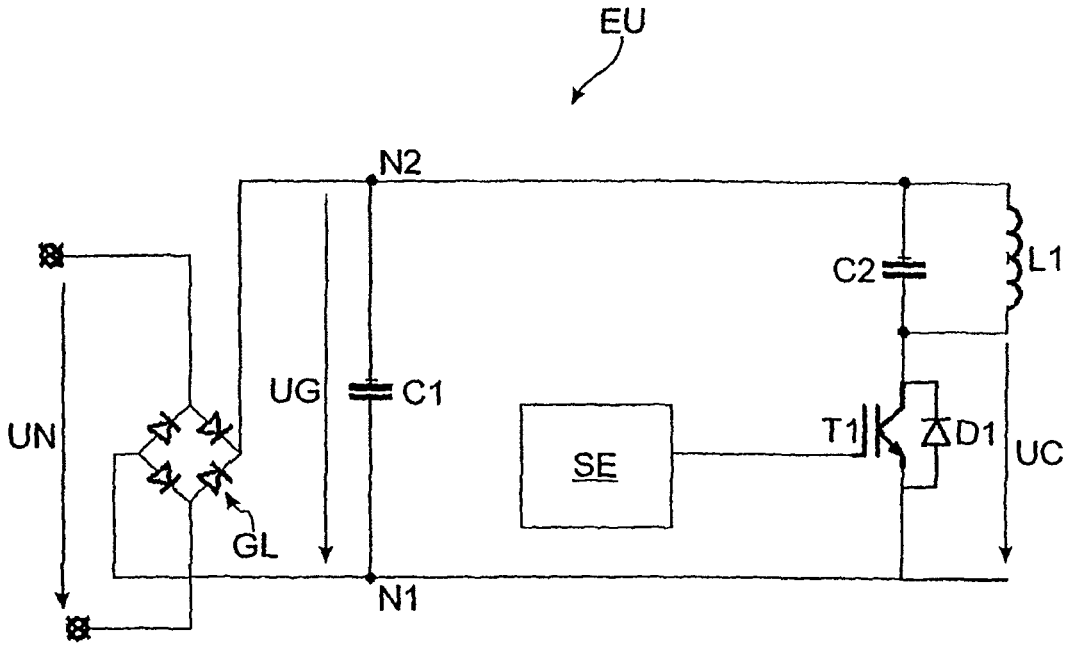
FIG. 1 A circuit diagram of a single transistor converter operated with the operating method according to the invention.

FIG. 1 shows a circuit diagram of an induction heating device in the form of a single transistor converter EU. The induction heating device can also comprise further (not shown), identically constructed single transistor converters EU and additional conventional components, e.g. operating or control elements for adjusting the power level, etc.

The single transistor converter EU comprises a bridge rectifier GL, which generates an intermediate circuit direct voltage UG from the input alternating supply voltage UN of 230 V and 50 Hz, a buffer or intermediate circuit capacitor C1 for stabilizing or buffering the intermediate circuit direct voltage UG looped in between the output terminal N1 and N2 of rectifier GL, an induction coil L1 and a capacitor C2, which are connected in parallel and form a parallel resonant circuit, a controllable switching element in the form of an IGBT transistor T1, which is looped in series with the resonant circuit between the output terminals N1, N2 of rectifier GL, a freewheeling diode D1 connected in parallel to a collector-emitter junction of the IGBT transistor T1 and a control unit SE, e.g. in the form of a microprocessor or a digital signal processor.

The control unit SE implements the inventive operating method, described hereinafter relative to FIG. 2, for the operation of the single transistor converter EU and can comprise or be coupled to further (not shown) operating means and/or sensors, e.g. for monitoring the supply voltage gradient.

Figure 2:
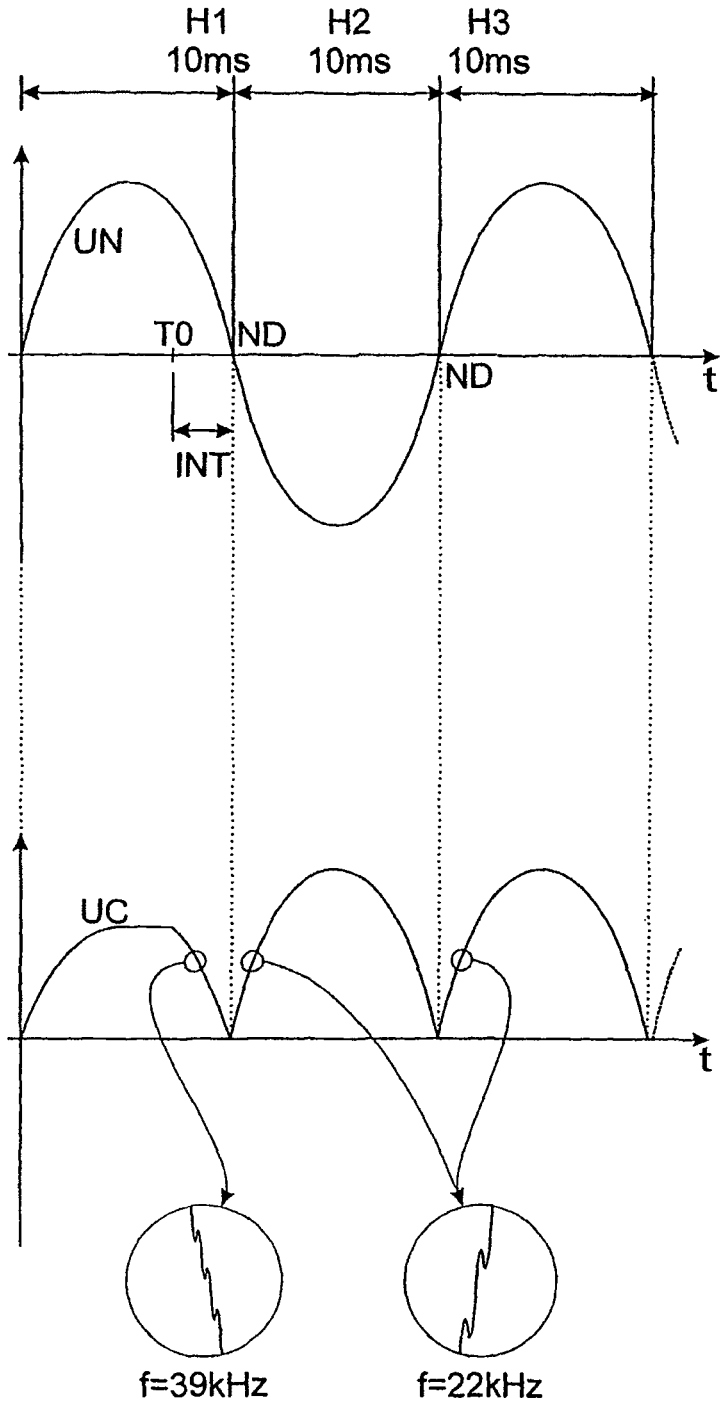
FIG. 2 Timing diagrams of signals of the single transistor converter of FIG. 1.

FIG. 2 shows in not to scale form timing diagrams of signals of the single transistor converter EU of FIG. 1. As a result of the supply voltage of the input alternating supply voltage UN of 50 Hz, every 10 ms there is a zero passage between adjacent supply half-waves H1 to H3 of the input alternating supply voltage UN. The single transistor converter EU is operated in ⅔ supply half-wave operation, i.e. only during two of the three supply half-waves is power fed into the parallel resonant circuit or into induction coil L1. In FIG. 2 half-waves H2 and H3 are the active half-waves during which power is fed in, whilst the supply half-wave H1 is the inactive high-wave during which there is no power supply. During the inactive half-wave H1, with the exception of a transition range or a predeterminable discharge time range INT during which the intermediate circuit capacitor C1 is discharged, there is an IGBT transistor T1 blocking.

UC is a voltage at the collector of the IGB transistor T1 relative to a reference potential applied to terminal N1 of rectifier GL. During inactive half-waves, with the IGB transistor T1 blocked, there is a no-load voltage with an amount of a peak value of the alternating supply voltage UN at the collector, i.e. in the embodiment shown approximately 325V.

During the active half-waves H2 and H3 power is fed in to induction coil L1. This can take place in the usual way, e.g. by controlling IGB transistor T1 with a square-wave voltage signal having a frequency and a duty cycle set as a function of the power to be fed in during the half-wave.

In order to prevent a starting current pulse at the transition from half-wave H1 to half-wave H2, during the discharge time range or time interval INT starting at a time T0, approximately 2.5 ms before a zero passage ND between half-waves H1 and H2 intermediate circuit capacitor C1 is continuously discharged to approximately 0 V by controlling the IGB transistor T1. For this purpose the IGB transistor T1 is controlled with a (not shown) square-wave voltage signal with a frequency of approximately 39 kHz and an on/off ratio of approximately 1/378. The control pulses are so short that they are insufficient for removing the charge at the IGB transistor gate. Thus, IGB transistor T1 is not completely switched through and instead passes into a linear operating mode. The voltage UC at the collector of the IGB transistor T1, which for this case corresponds to the voltage UG at the intermediate circuit capacitor C1, as shown, drops away slowly along the supply half-wave as the envelope curve to approximately 0 V. In the detail enlargement shown in FIG. 2 signal UC is shown with a greater time resolution and as a result the switching frequency of the IGBTs of approximately 39 kHz during the discharge process is rendered visible.

As the IGBT T1 does not completely conduct or is switched through, there is merely a low current through the induction coil L1. Noise caused by the coil current is consequently prevented or significantly reduced.

During the half-waves H2 and H3 IGB transistor T1 is controlled conventionally by a (not shown) square-wave voltage signal. FIG. 2 shows the envelope curve of the resulting voltage UC and a detail enlargement of signal UC with a greater time resolution. As a result of the oscillation in the parallel resonant circuit the voltage UC rises to values well above the no-load voltage. The envelope curve has a sinusoidal course following the rectified input alternating supply voltage UN. The course of the voltage UC shown is repeated during half-wave H3. In this operating mode the frequency of the control signal of the IGBTs T1 is approximately 22 kHz.

In a (not shown) half-wave following half-wave H3 IGB transistor T1 is deactivated, so that voltage UC again rises to its no-load value of approximately 325 V. During the transition to a following, active half-wave the discharge process is repeated in the manner shown for half-wave H1. The described processes are periodically repeated.

Thus, the converter circuit can start with low voltages and currents and with the rise of the supply half-wave can regulate to its actual operating point with a suitable frequency and duty cycle.

As a function of the IGB transistor used, a control voltage used for its driving or control, the capacitance of the intermediate circuit capacitor and the resonant circuit dimensioning, the discharge frequency and duty cycle can be adapted in order to operate linearly the IGB transistor during the discharge.

As a result of the inventive discharge of the intermediate circuit capacitor, as shown, a power control with half-wave patterns of the single transistor converter EU is possible without giving rise to noise. If in this case power is to be supplied in a half-wave, the intermediate circuit capacitor is discharged at the end of the preceding, non-active half-wave. This permits a high power setting range without starting current peaks unduly stressing the IGB transistor T1. Thus, there is a rise in the service life of the components.

Figure 3:
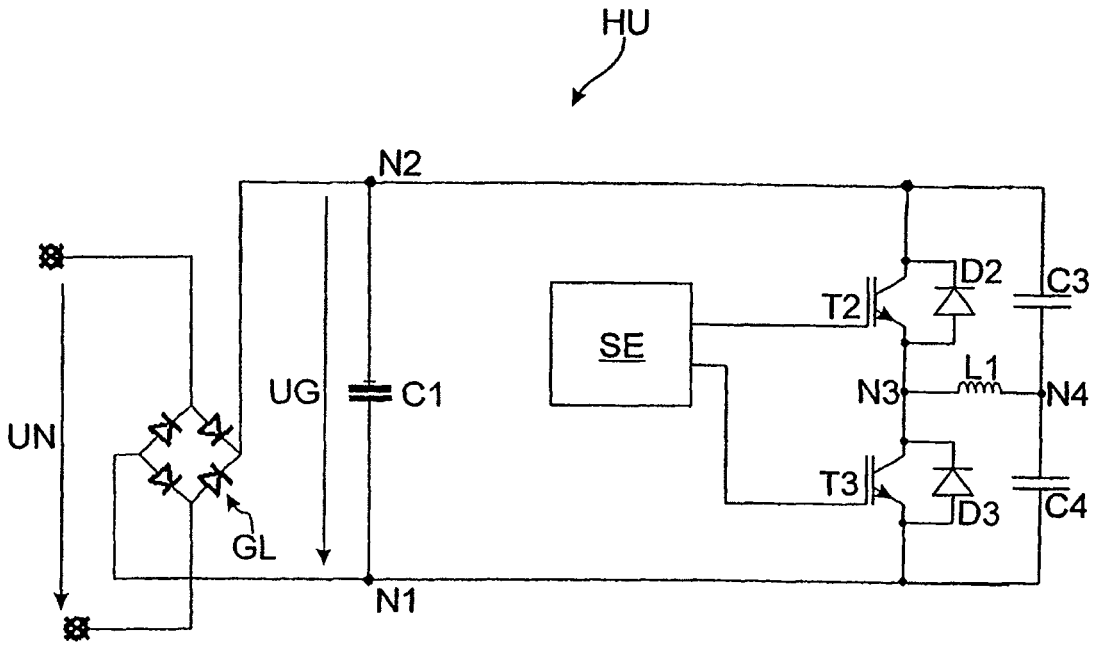
FIG. 3 A circuit diagram of a converter in half-bridge circuit operated with the inventive operating method.

The circuit diagram of FIG. 3 shows a frequency converter HU in a half-bridge circuit and which is operated by the operating method according to the invention. Components having an identical function to FIG. 1 carry the same reference numerals and reference should be made to FIG. 1 concerning their operation.

A half-bridge is formed from IGBTs T2 and T3 which are looped in serially between the output terminals N1 and N2 of rectifier GL. Freewheeling diodes D2/D3 are connected in parallel to the in each case associated collector-emitter junction of the IGBTs T2/T3. Capacitors C3 and C4 are also looped in serially between output terminals N1 and N2. Induction coil L1 is looped in between a connecting node N3 of IGBTs T2 and T3 and a connecting node N4 of capacitors C3 and C4, and together with the latter forms a series resonant circuit.

IGBTs T2 and T3 are controlled by control unit SE. Power adjustment can take place in the conventional manner, e.g. by a frequency adjustment of the control signals of the IGBTs produced by control unit SE.

After switching on converter HU and prior to the generation of heating power, intermediate circuit capacitor C1 and capacitors C3 and C4 are discharged by controlling IGBTs T2 and T3. This takes place in the same way as described relative to FIG. 2 by controlling IGBTs T2 and T3 with square-wave voltage signals with a suitable frequency and suitable on/off ratio. The control pulses are again so short that they are inadequate for removing the charge at the particular IGB transistor gate. Thus, IGB transistors T2 and T3 are not completely switched through and instead pass into a linear operating mode.

Thus, also with such a frequency converter in half-bridge circuit, disturbing clicking noises are effectively prevented during a switching on process or following a deactivation of the heating power and subsequent reactivation.

Figure 4:
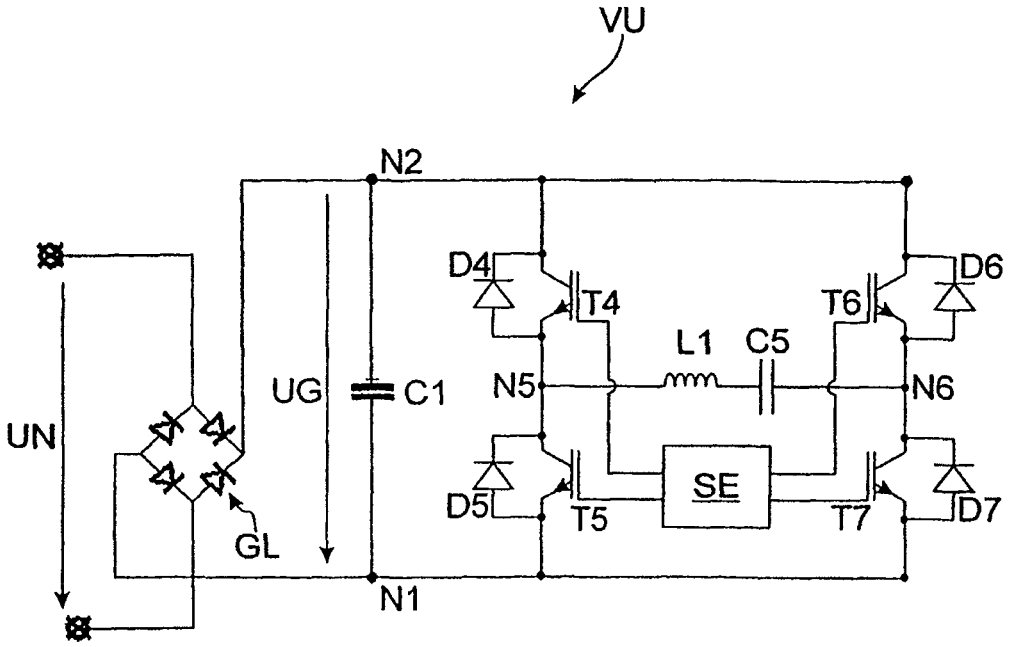
FIG. 4 A circuit diagram of a converter in full bridge circuit operated with the inventive operating method.

FIG. 4 shows a circuit diagram of a converter VU in full bridge circuit operated with the inventive operating method.

Components having the same function as in FIG. 1 carry the same reference numerals and reference should be made to the description given in connection with FIG. 1.

A first half-bridge is formed from IGBTs T4 and T5 and a second half-bridge from IGBTs T6 and T7, which are in each case serially looped in between output terminals N1 and N2 of rectifier GL. Freewheeling diodes D4 to D7 are connected in parallel to in each case an associated collector-emitter junction of IGBTs T4 to T7. Induction coil L1 and a capacitor C5 are serially looped in between a connection node N5 of IGBTs T4 and T5 and a connection node N6 of IGBTs T6 and T7. Induction coil L1 and capacitor C5 form a series resonant circuit.

IGBTs T4 to T7 are controlled by control unit SE. Power adjustment can take place in a conventional manner, e.g. by a frequency adjustment of the control signals of the IGBTs generated by control unit SE.

Following the switching on of frequency converter VU and prior to heating power generation, intermediate circuit capacitor C1 is discharged by controlling IGBTs T4 to T7. This takes place in the same way as in the method described relative to FIG. 2 by controlling IGBTs T4 to T7 with square-wave voltage signals with a suitable frequency and on/off ratio. The control pulses are once again so short that they are inadequate for removing the charge at the given IGBT transistor gate. Thus, the IGB transistors T4 to T7 are not completely switched through and instead pass into a linear operating mode.

For discharging intermediate circuit capacitor C1 all the IGBTs T4 to T7 or only specific IGBTs can be controlled in such a way that a current path is formed for discharging intermediate circuit capacitor C1, e.g. only T4 and T5, only T6 and T7, only T4 and T7 or only T6 and T5 are controlled for discharge purposes.

Thus, also in the case of a frequency converter in full bridge circuit, disturbing clicking noises can be effectively prevented during a switching on process or following a deactivation of the heating power and subsequent reactivation thereof.

In the embodiment shown the supply voltage is 230 V and the supply frequency 50 Hz. Obviously the operating methods shown can be adapted to other supply voltages and frequencies.

The invention claimed is:

1. A method for operating an induction heating device comprising:

generating, via a frequency converter, a control voltage for an induction coil, the frequency converter comprising:

a rectifier which rectifies an alternating supply voltage, an intermediate circuit capacitor coupled between output terminals of the rectifier and buffering the rectified voltage, and at least one controllable switching element coupled between output terminals of the rectifier, comprising during a predetermined discharge time period, prior to a zero passage of the alternating supply voltage, discharging the intermediate circuit capacitor to a threshold value by controlling the at least one switching element before the induction coil is controlled for generating an adjustable heating power.

2. The method according to claim 1, wherein the frequency converter comprises a single transistor converter.

3. The method according to claim 1, wherein the frequency converter comprises a converter in full bridge circuit or half-bridge circuit, the at least one switching element forming part of the bridge.

4. The method according to claim 1, wherein the predetermined discharge time period commences 1 ms to 5 ms prior to a zero passage of the alternating supply voltage.

5. The method according to claim 1, wherein the threshold value is between 0 and 20 V.

6. The method according to claim 1, wherein the at least one switching element comprises a transistor.

7. The method according to claim 6, wherein, for discharging the intermediate circuit capacitor during the discharge the IGB transistor is controlled such that the IGB transistor operates in a linear operating state.

8. The method according to claim 1, wherein the at least one switching element is controlled by a pulse-width modulated square-wave voltage signal for discharging the intermediate circuit capacitor.

9. The method according to claim 8, wherein the square-wave voltage signal has a frequency of 20 to 50 kHz.

10. The method according to claim 8, wherein the square-wave voltage signal has an on/off ratio in the range of 1/300 to 1/500.

11. The method according to claim 1, wherein the adjustable heating power is generated using a half-wave pattern, the intermediate circuit capacitor being discharged prior to an activation of a half-wave.

12. The method according to claim 11, wherein one of three or two of three half-waves are activated.

13. The method according to claim 6, wherein the transistor comprises an insulated gate bipolar (IGB) transistor.

14. An apparatus for operating an induction heating device comprising:

an induction coil, a frequency converter for generating a control voltage for the induction coil comprising:

a rectifier which rectifies an alternating supply voltage, an intermediate circuit capacitor coupled between output terminals of the rectifier and configured to buffer the rectified voltage, and at least one controllable switching element coupled between output terminals of the rectifier, and a controller, wherein during a predetermined discharge time period, prior to a zero passage of the alternating supply voltage, the controller provides a signal to control the at least one switching element to discharge the intermediate circuit capacitor to a threshold value before the induction coil is controlled for generating an adjustable heating power.

15. The apparatus of claim 14, wherein the frequency converter comprises a single transistor converter.

16. The apparatus of claim 14, wherein the frequency converter comprises a converter in full bridge circuit or half-bridge circuit, the at least one switching element forming part of the bridge.

17. The apparatus of claim 14, wherein the predetermined discharge time period commences 1 ms to 5 ms prior to a zero passage of the alternating supply voltage.

* * * * *